US012410687B2

(12) United States Patent
Alsunnary et al.

(10) Patent No.: US 12,410,687 B2
(45) Date of Patent: Sep. 9, 2025

(54) DOSING CHEMICALS WITHIN A WELLBORE

(71) Applicant: Saudi Arabian Oil Company, Dhahran (SA)

(72) Inventors: Khaled Alsunnary, Dammam (SA); Khalid Alhamed, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 233 days.

(21) Appl. No.: 17/739,474

(22) Filed: May 9, 2022

(65) Prior Publication Data

US 2023/0358116 A1 Nov. 9, 2023

(51) Int. Cl.

| | |
|---|---|
| ***E21B 37/06*** | (2006.01) |
| ***E21B 33/12*** | (2006.01) |
| ***E21B 34/06*** | (2006.01) |

(52) U.S. Cl.
CPC ..... *E21B 37/06* (2013.01); *E21B 33/1208* (2013.01); *E21B 34/06* (2013.01)

(58) Field of Classification Search
CPC ..... E21B 34/066
See application file for complete search history.

(56) References Cited

U.S. PATENT DOCUMENTS

| | | | | |
|---|---|---|---|---|
| 2,994,378 | A | 8/1961 | Reistle, Jr. | |
| 5,655,601 | A | 8/1997 | Odde et al. | |
| 2005/0035224 | A1 | 2/2005 | Dodd | |
| 2010/0155054 | A1 | 6/2010 | Innes et al. | |
| 2011/0048724 | A1* | 3/2011 | Pringle | E21B 28/00 166/320 |
| 2019/0128081 | A1* | 5/2019 | Ross | E21B 34/066 |

OTHER PUBLICATIONS

SAIP Examination Report in Saudi Arabian Appln. No. 123447022, dated Jan. 27, 2025, 14 pages (with English translation).

* cited by examiner

*Primary Examiner* — William D Hutton, Jr.
*Assistant Examiner* — Avi T Skaist
(74) *Attorney, Agent, or Firm* — Fish & Richardson P.C.

(57) ABSTRACT

A chemical canister is configured to be placed in a wellbore. The chemical canister includes the following features. A housing defines a chemical reservoir. A check valve regulates flow between the reservoir and an outside environment.

9 Claims, 3 Drawing Sheets

DOSING CHEMICALS WITHIN A WELLBORE

TECHNICAL FIELD

This application relates to hydrocarbon production.

BACKGROUND

During hydrocarbon production, hydrocarbons are produced from wellbores. As hydrocarbons are produced, scale builds up within the wellbore. Scale build-up reduces production rates, so production wells sometimes include maintenance schedules to mitigate or reduce scale build-up.

SUMMARY

This specification describes technologies relating to dosing chemicals within a wellbore.

An example implementation of the subject matter described with in this disclosure is a chemical canister configured to be placed in a wellbore. The chemical canister includes the following features. A housing defines a chemical reservoir. A check valve regulates flow between the reservoir and an outside environment.

Aspects of the example chemical canister, which can be combined with the example chemical canister alone or in combination with other aspects, include the following. A pressurized chemical is within the chemical reservoir.

Aspects of the example chemical canister, which can be combined with the example chemical canister alone or in combination with other aspects, include the following. The chemical is a scale inhibitor.

Aspects of the example chemical canister, which can be combined with the example chemical canister alone or in combination with other aspects, include the following. The check valve is configured to regulate a chemical flow in response to a drawdown pressure of the wellbore.

Aspects of the example chemical canister, which can be combined with the example chemical canister alone or in combination with other aspects, include the following. A first swellable packer is at an uphole end of the housing. A second swellable packer at a downhole end of the housing. The first swellable packer and the second swellable packer are configured to support the chemical canister within the wellbore.

An example implementation of the subject matter described within this disclosure is a method with the following features. A chemical canister is received by a wellbore. The chemical canister is retained within the wellbore. A dosage of a chemical is released by the chemical canister responsive to fluid flow within the wellbore.

Aspects of the example method, which can be combined with the example method alone or in combination with other aspects, include the following. Releasing a dosage of the chemical includes adjusting a drawdown pressure of the wellbore and releasing a dosage, by the canister, inversely proportional to the drawdown pressure.

Aspects of the example method, which can be combined with the example method alone or in combination with other aspects, include the following. The chemical canister is released from the wellbore.

Aspects of the example method, which can be combined with the example method alone or in combination with other aspects, include the following. The chemical canister is received by the wellbore after the chemical canister has been released by the wellbore.

Aspects of the example method, which can be combined with the example method alone or in combination with other aspects, include the following. The chemical canister is a first chemical canister. The method further includes receiving a second chemical canister by the wellbore after the first chemical canister has been released by the wellbore.

Aspects of the example method, which can be combined with the example method alone or in combination with other aspects, include the following. The wellbore is a first wellbore. The method further includes receiving the chemical chamber by a second wellbore after the chemical chamber has been released by the first wellbore.

An example implementation of the subject matter described within this disclosure is a production well system with the following features. A chemical canister is within a wellbore. The chemical canister includes a housing defining a chemical reservoir and a check valve regulating flow between the reservoir and an outside environment.

Aspects of the example production well system, which can be combined with the example production well system alone or in combination with other aspects, include the following. The chemical canister includes a pressurized chemical within the chemical reservoir.

Aspects of the example production well system, which can be combined with the example production well system alone or in combination with other aspects, include the following. The chemical is a scale inhibitor.

Aspects of the example production well system, which can be combined with the example production well system alone or in combination with other aspects, include the following. The check valve is configured to regulate a chemical flow in response to a drawdown pressure of the wellbore.

Aspects of the example production well system, which can be combined with the example production well system alone or in combination with other aspects, include the following. The chemical canister further includes a first swellable packer at an uphole end of the housing and a second swellable packer at a downhole end of the housing. The first swellable packer and the second swellable packer are configured to support the chemical canister within the wellbore.

Aspects of the example production well system, which can be combined with the example production well system alone or in combination with other aspects, include the following. The wellbore includes an openhole completion.

Aspects of the example production well system, which can be combined with the example production well system alone or in combination with other aspects, include the following. The wellbore includes a lateral section.

Aspects of the example production well system, which can be combined with the example production well system alone or in combination with other aspects, include the following. The lateral section is a first lateral section, the chemical canister is a first chemical canister, the housing is a first housing, the check valve is a first check valve, and the reservoir is a first reservoir. The wellbore further includes a second lateral section. The production well system further includes a second chemical canister within the second lateral section of the wellbore. The second chemical canister includes a second housing defining a second chemical reservoir and a second check valve regulating flow between the second chemical reservoir and an outside environment.

Particular embodiments of the subject matter described in this specification can be implemented so as to realize one or more of the following advantages. The subject matter described herein allows for a continuous dosing of well chemicals based on a flowrate of the well. The subject matter described herein allows for such dosing to occur during production without the need to shut-in the well.

The details of one or more embodiments of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Production well maintenance typically includes shutting in a production well and cleaning the wellbore. Such cleaning, in some instances, includes scraping, chemical injection, or both. These techniques are delivered from a topside facility and require shutting in the production well for the duration of the maintenance.

This disclosure relates to a scale inhibiting maintenance system that includes a chemical canister to be placed within a wellbore. The chemical canister includes a housing defining a chemical reservoir filled with a pressurized chemical, such as a scale inhibitor. The canister defines an outlet with a check valve regulating flow between the reservoir and an outside environment. The canister remains within the wellbore until the canister is emptied. The duration of chemical dosing from the canister is greater than the typical time between topside initiated maintenance procedures.

Figure 1:
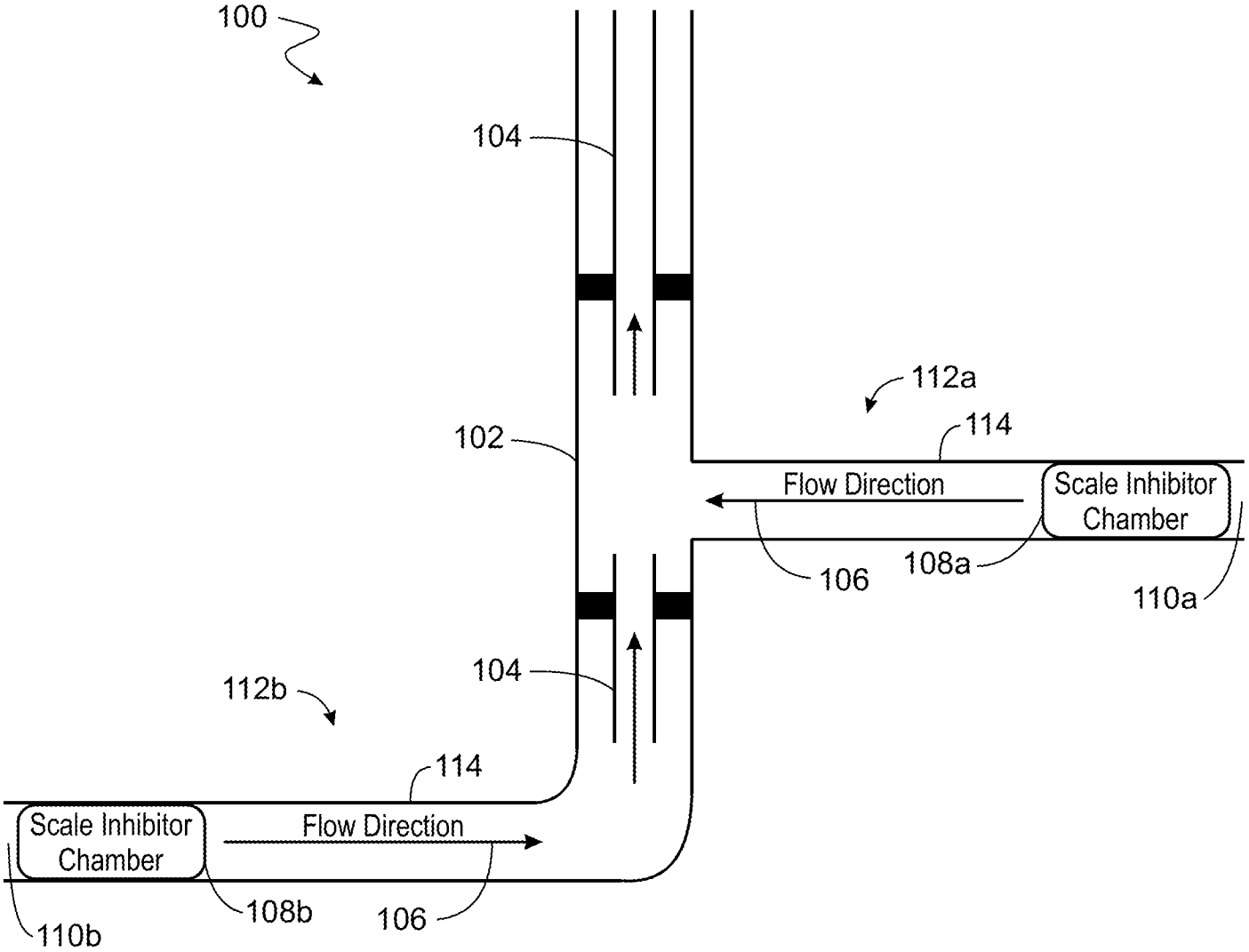
FIG. 1 is a cross-sectional view of a production wellbore.

FIG. 1 is a cross-sectional view of a production well system 100. The production well system 100 includes a wellbore 102. The wellbore 102 includes one or more strings of production tubing 104 that direct production fluids 106 from the wellbore 102 up to a topside facility (not shown). A chemical canister 108*a* is installed near a downhole end 110*a* of the wellbore 102. The chemical canister 108*a* is configured to release a dosage of a chemical within the wellbore 102 in response to a drawdown pressure of the wellbore 102. As the drawdown pressure of the wellbore is lowered, the flow from the wellbore increases, and the dosage of the chemical released by the canister increases proportional to the flow and inversely proportional to the drawdown pressure. In the illustrated example, the wellbore 102 includes a first lateral section 112*a* with the canister 108*a* being at a downhole end 110*a* of the first lateral section 112*a*. In implementations where multiple lateral sections are used, such as the second lateral section 112*b*, then, in some implementations, a second canister 108*b* is installed at a downhole end 110*b* of the second lateral section 112*b*. The first canister 108*a* and the second canister 108*b* are substantially similar to one another in structure (described later); however, sizes and configured dosage rates can differ between the first canister 108*a* and the second canister 108*b* depending upon the production characteristics of each lateral section 112*a* and 112*b*.

While the illustrated implementation includes a vertical section and lateral sections 112*a* and 112*b* with canisters 108 at the downhole ends 110 of the lateral sections 112*a* and 112*b*, other well arrangements can be used without departing from this disclosure. For example, a vertical wellbore with a single canister located proximal to the downhole end of the wellbore. Similarly, a deviated wellbore can use the subject matter described herein. The canisters 108 can be used with a variety of completions. For example, the canisters 108 can be used with an openhole completion 114. In some implementations, the canisters 108 are used in a gravel pack completion. The canister 108 can be used in any completion type without departing from this disclosure.

Figure 2:
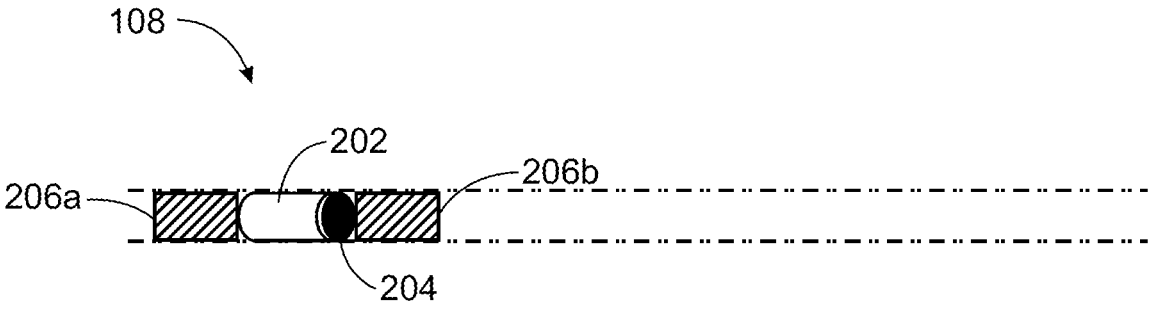
FIG. 2 is a cross-sectional schematic diagram of an example chemical chamber within a wellbore.

FIG. 2 is a cross-sectional schematic diagram of an example chemical canister 108. The chemical canister 108 is configured to be placed within a wellbore and includes a housing 202 defining a chemical reservoir. The housing 202 defines an outlet in which a check valve 204 resides. The check valve 204 is configured to regulate a flow between the reservoir and an outside environment. More specifically, the check valve 204 keeps well fluids out of the canister 108, and allows the pressurized chemicals out of the canister once the drawdown pressure is lower than the internal pressure of the chemicals within the canister. The pressurized chemicals can be pressurized in a variety of ways, for example a spring, piston, or bladder can be included within the canister in some implementations. In some implementations a pressurized gas is included within the canister to provide pressure. In some implementations, the pressure of the pressurized chemical is sufficient for flowing a dosage of the chemical from the canister 108. The flow rate of chemicals flowing out of the canister 108 is dependent upon the drawdown pressure. That is, as the drawdown pressure is decreased, flow of the chemicals from the canister 108 increase. While primarily described in this disclosure as being a scale inhibitor, other pressurized chemicals can be used within the canister 108 without departing from this disclosure.

The canister 108 includes a first swellable packer 206*a* at an uphole end of the housing 202 and a second swellable packer 206*b* at a downhole end of the housing 202. Both the first swellable packer 206*a* and the second swellable packer 206*b* are configured to support the chemical canister 108 within the wellbore. The swellable packers 206 are configured to support the canister in a variety of wellbore configurations, for example, within an openhole section. In some implementations, the canister is installed downhole of perforations within the wellbore. A variety of swellable packers can be used without departing from this disclosure. For example, in some implementations, hydraulic packers or swellable packers (which swell from exposure to well fluids) are used.

Figure 3:
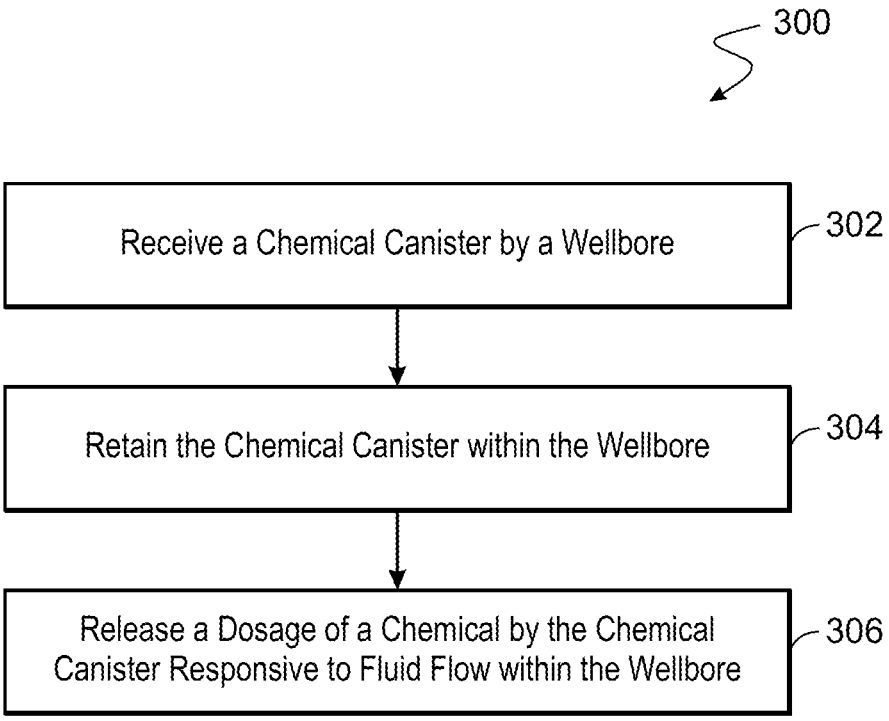
FIG. 3 is a flowchart of an example method that can be used with aspects of this disclosure.

FIG. 3 is a flowchart of an example method 300 that can be used with aspects of this disclosure. At 302, a chemical canister by is received by a wellbore. At 304, the chemical canister is retained within the wellbore. At 306, a dosage of a chemical is released by the chemical canister responsive to fluid flow within the wellbore. Releasing the dosage of chemical involves adjusting a drawdown pressure of the wellbore. The dosage of chemicals is released by the canister releasing at a rate inversely proportional to the drawdown pressure.

Once the canister is emptied, or if dosage and/or chemicals need to be changed, the canister can be removed from the wellbore. In such situations, the chemical canister is released from the wellbore. Once the canister has been refilled, serviced, refurbished, or a combination, the chemical canister is received once again by the wellbore. In some implementations, a second, new canister is received by the wellbore in lieu of a refilled or refurbished canister. In some instances, the canister released from the wellbore is installed into or received by a second wellbore. That is, the canisters are reusable.

While this specification contains many specific implementation details, these should not be construed as limitations on the scope of what may be claimed, but rather as descriptions of features specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. Moreover, the separation of various system components in the embodiments described above should not be understood as requiring such separation in all embodiments, and it should be understood that the described components and systems can generally be integrated together in a single product or packaged into multiple software products.

Thus, particular embodiments of the subject matter have been described. Other embodiments are within the scope of the following claims. In some cases, the actions recited in the claims can be performed in a different order and still achieve desirable results. In addition, the processes depicted in the accompanying figures do not necessarily require the particular order shown, or sequential order, to achieve desirable results.

What is claimed is:

1. A chemical canister configured to be placed in a wellbore, the chemical canister comprising:

a housing defining a chemical reservoir;

a chemical in the chemical reservoir;

a check valve regulating flow between the chemical reservoir and an outside environment, wherein the check valve is configured to regulate a chemical flow in response to a drawdown pressure of the wellbore; and a spring or ladder in the housing pressurizing the chemical in the chemical reservoir such that a dosage of chemical released from the chemical canister increases as pressure in the outside environment decreases.

2. The chemical canister of claim 1, wherein the chemical is a scale inhibitor.

3. The chemical canister of claim 1, further comprising:

a first swellable packer at an uphole end of the housing; and a second swellable packer at a downhole end of the housing, the first swellable packer and the second swellable packer configured to support the chemical canister within the wellbore.

4. A production well system comprising:

a wellbore;

a chemical canister within the wellbore, the chemical canister comprising:

a housing defining a chemical reservoir;

a chemical in the chemical reservoir;

a check valve regulating flow between the chemical reservoir and an outside environment, wherein the check valve is configured to regulate a chemical flow in response to a drawdown pressure of the wellbore; and a spring or ladder in the housing pressurizing the chemical in the chemical reservoir such that a dosage of chemical released from the chemical canister increases as pressure in the outside environment decreases.

5. The production well system of claim 4, wherein the chemical is a scale inhibitor.

6. The production well system of claim 4, wherein the chemical canister further comprises:

a first swellable packer at an uphole end of the housing; and a second swellable packer at a downhole end of the housing, the first swellable packer and the second swellable packer configured to support the chemical canister within the wellbore.

7. The production well system of claim 4, wherein the wellbore includes an openhole completion.

8. The production well system of claim 4, wherein the wellbore comprises a lateral section.

9. The production well system of claim 8, wherein the lateral section is a first lateral section, the chemical canister is a first chemical canister, the housing is a first housing, the check valve is a first check valve, and the reservoir is a first reservoir, the wellbore further comprising a second lateral section, the production well system further comprising:

a second chemical canister within the second lateral section of the wellbore, the second chemical canister comprising:

a second housing defining a second chemical reservoir; and a second check valve regulating flow between the second chemical reservoir and an outside environment.

* * * * *